US008526833B2

(12) United States Patent
Kojo

(10) Patent No.: US 8,526,833 B2
(45) Date of Patent: Sep. 3, 2013

(54) IMAGE FORMING APPARATUS, CARTRIDGE, AND APPARATUS MAIN UNIT

(75) Inventor: Hidehiko Kojo, Osaka (JP)

(73) Assignee: Kyocera Mita Corporation (JP)

( * ) Notice: Subject to any disclaimer, the term of this patent is extended or adjusted under 35 U.S.C. 154(b) by 438 days.

(21) Appl. No.: 12/692,673

(22) Filed: Jan. 25, 2010

(65) Prior Publication Data

US 2010/0196019 A1 Aug. 5, 2010

(30) Foreign Application Priority Data

Jan. 30, 2009 (JP) ..... 2009-019106

(51) Int. Cl.
*G03G 15/00* (2006.01)

(52) U.S. Cl.
USPC ..... 399/12

(58) Field of Classification Search
USPC ..... 399/12, 13, 111, 262; 340/10.4
See application file for complete search history.

(56) References Cited

U.S. PATENT DOCUMENTS

| | | | | |
|---|---|---|---|---|
| 6,343,883 | B1 * | 2/2002 | Tada et al. | 399/12 X |
| 6,477,335 | B1 * | 11/2002 | Surya et al. | 399/12 |
| 6,766,119 | B2 * | 7/2004 | Urabe | 399/12 |
| 7,194,212 | B2 * | 3/2007 | Kumai et al. | 399/12 |
| 7,440,705 | B2 * | 10/2008 | Hatakeyama | 399/12 X |
| 2007/0297814 | A1 * | 12/2007 | Kasai | 399/12 |

FOREIGN PATENT DOCUMENTS

| | | |
|---|---|---|
| JP | 4-338989 | 11/1992 |
| JP | 2007-96689 | 4/2007 |

* cited by examiner

*Primary Examiner* — Sandra Brase
(74) *Attorney, Agent, or Firm* — Gerald E. Hespos; Michael J. Porco; Matthew T. Hespos

(57) ABSTRACT

A magnet is arranged on an RFID tag to be attached to a cartridge. A Hall element is arranged on a printer-side RFID board in a position corresponding to the magnet. When the cartridge is mounted, a printer-side RFID communication section identifies whether or not the mounted cartridge is a certified product according to classification information stored on the RFID tag and a presence/absence of a detection signal from the Hall element.

5 Claims, 5 Drawing Sheets

IMAGE FORMING APPARATUS, CARTRIDGE, AND APPARATUS MAIN UNIT

BACKGROUND OF THE INVENTION

1. Field of the Invention

The present invention relates to image forming apparatuses such as printers and copiers, apparatus main units of these image forming apparatuses, and cartridges containing toner to be used in these image forming apparatuses, and particularly relates to techniques of carrying out management of these cartridges using wireless tags.

2. Description of the Related Art

In image forming apparatuses such as printers, fax machines, and copiers, which are provided with development devices that develop an electrostatic latent image on the surface of a photosensitive drum using a two-constituent developing agent constituted by toner and carrier, image forming is carried out by turning the electrostatic latent image into a toner image using toner supplied from a cartridge mounted in the apparatus main unit, then transferring this toner image to paper or the like. Then, when the toner in the cartridge becomes low, toner is replenished into the image forming apparatus by having a user replace the cartridge with a new cartridge.

In this case, although there is no problem if the newly replaced cartridge is a legitimate and genuine product of the maker of the image forming apparatus or a product certified by the maker (hereinafter collectively referred to as "certified product"), cases are being found in which cartridges other than certified products (non-certified products) are being used. When a cartridge other than a certified product is used, it is not only that the full capabilities of the image forming apparatus are not achieved, but it also possibly leads to malfunctioning of the image forming apparatus.

For this reason, many image forming apparatuses developed in recent years make use of technologies such as RFID (radio frequency identification: wireless automatic identification) in carrying out cartridge management. In this case, a wireless tag in which cartridge and toner information is stored as tag information is attached to the cartridge, and after the cartridge is mounted, a communication circuit arranged on the main unit side of the image forming apparatus reads the tag information, thereby identifying whether or not the cartridge that is mounted is a certified product.

SUMMARY OF THE INVENTION

The present invention improves the above-described conventional technologies.

That is, one aspect of the present invention is an image forming apparatus, provided with: an apparatus main unit that forms an image on a recording medium based on image data; and a cartridge that contains a developing agent and is detachably mountable with respect to the apparatus main unit, wherein the cartridge is provided with: a wireless tag that is stored classification information of the cartridge; and a magnet that is attached in a different position according to a type of the cartridge, and wherein the apparatus main unit is provided with: a communication section that read the classification information of the cartridge stored in the wireless tag by using wireless communication; a magnetoelectric transducer that is arranged in a position that intersects a magnetic flux of the magnet attached to the cartridge when a cartridge that is certified in advance is mounted to the apparatus main unit, and detects the magnetic flux of the magnet to output a detection signal; a storage section that stores classification information of the apparatus main unit; and an identifying section that identifies the mounted cartridge as a certified product when the classification information of the cartridge read by the communication section and the classification information of the apparatus main unit stored in the storage section are in agreement and the detection signal has been outputted from the magnetoelectric transducer.

DETAILED DESCRIPTION OF THE PREFERRED EMBODIMENTS

Hereinafter, an image forming apparatus, a cartridge, and an apparatus main unit according to an embodiment of the present invention are described with reference to the accompanying drawings. It should be noted that although a printer is described as an example of an image forming apparatus according to the present invention in the following embodiments, in addition to this, a copier and a multi-function machine provided with functions such as copying, scanning, faxing, and printing are also possible.

Figure 1:
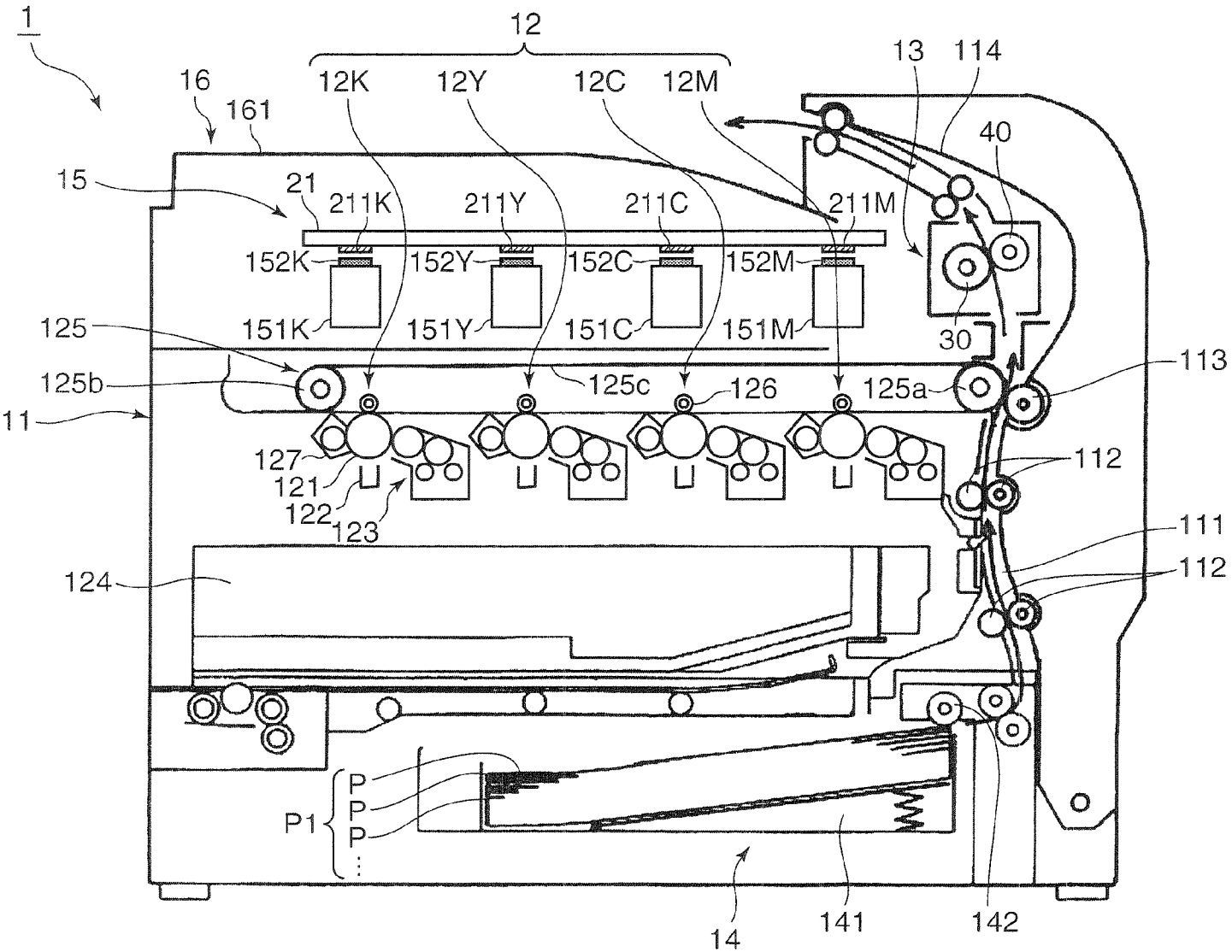
FIG. 1 is an outline cross-sectional view for describing an embodiment of an internal structure of a printer.

FIG. 1 is an outline cross-sectional view for describing an embodiment of an internal structure of a printer 1 according to the present invention. As shown in FIG. 1, the printer 1 according to the present embodiment is provided with an apparatus main unit 11 that is presented in the form of a box. The apparatus main unit 11 is internally provided with an image forming section 12 that forms an image based on image data transmitted from an external device such as a computer, a fixing section 13 that executes a fixing process on a toner image that is formed by the image forming section 12 and transferred to a recording paper P as a transfer material, a paper storage section 14 that stores recording papers, and a toner supply section 15 that supplies toner to the image forming section 12, and is also provided with a paper discharge section 16 above the apparatus main unit 11 to which the recording papers P are discharged after the fixing process.

Arranged in appropriate locations on an upper surface of the apparatus main unit 11 are an operation panel (not shown in diagram) for performing input operations such as output conditions of the recording paper P and a display panel (not shown in diagram) that displays messages and the like to the user. The operation panel is provided with a power key and a start button as well as settings keys for setting various functions.

The paper storage section 14 is provided with a paper tray 141 that is detachably mounted at a position below an exposure device 124 inside the apparatus main unit 11. The paper tray 141 is provided as a box structure whose upper surface is entirely open and is capable of storing a paper bundle P1 in which multiple recording papers P are stacked. A downstream end (right end in FIG. 1) of an upper surface of the uppermost recording paper P of the paper bundle P1 stored in the paper tray 141 is drawn out from the paper bundle P1 toward a paper transport path 111 by the driving of a pickup roller 142, and the recording papers P that are drawn out sheet by sheet are fed into a nip area between a second transfer roller 113 and a drive roller 125*a* (intermediate transfer belt 125*c*) in the image forming section 12 by way of the paper transport path 111 by the driving of transport roller pairs 112.

The image forming section 12 forms a toner image on the recording paper P supplied from the paper storage section 14, and in the present embodiment is provided with a black image forming section 12K that uses a black color toner (developing agent), a yellow image forming section 12Y that uses a yellow color toner, a cyan image forming section 12C that uses a cyan color toner, and a magenta image forming section 12M that uses a magenta color toner, which are disposed in order from an upstream side (left side in FIG. 1) to a downstream side. Hereinafter, these image forming section are referred to collectively as "image forming section (s) 12."

And each of the image forming sections 12 is provided with a photosensitive drum 121, a charging device 122 that uniformly charges a circumferential surface of the photosensitive drum 121, an exposure device 124 that forms an electrostatic latent image on the circumferential surface of the photosensitive drum 121 by irradiating a laser beam onto the charged circumferential surface of the photosensitive drum 121 based on image data, a development device 123 that forms a toner image by developing the electrostatic latent image that has been formed on the circumferential surface of the photosensitive drum 121, a transfer roller 126 that transfers the toner image formed on the circumferential surface of the photosensitive drum 121 to the intermediate transfer belt 125*c*, and a cleaning device 127 that removes residual toner from the circumferential surface of the photosensitive drum 121 after the toner image has been transferred.

An intermediate transfer member 125 is provided at a position above the photosensitive drums 121. The intermediate transfer member 125 has the endless intermediate transfer belt 125*c* that is arranged spanning between a drive roller 125*a* and an idler roller 125*b*, and the circumferential surface of each of the photosensitive drums 121 contacts a lower side of the intermediate transfer belt 125*c*. The intermediate transfer belt 125*c* is configured to circle around the drive roller 125*a* and the idler roller 125*b* in synchronization with the photosensitive drums 121 in a state in which the intermediate transfer belt 125*c* presses against the circumferential surface of each of the photosensitive drums 121 due to the transfer roller 126 that is provided corresponding to each of the photosensitive drums 121.

Accordingly, due to the circling of the intermediate transfer belt 125*c*, transfer of a toner image of black toner is carried out by the photosensitive drum 121 of the image forming section 12K onto the surface of the intermediate transfer belt, after which transfer of a toner image of yellow toner is carried out in a layered manner by the photosensitive drum 121 of the image forming section 12Y to the same position on the intermediate transfer belt 125*c*, after which transfer of a toner image of cyan toner is carried out in a layered manner by the photosensitive drum 121 of the image forming section 12C to the same position on the intermediate transfer belt 125*c*, and finally transfer of a toner image of magenta toner is carried out by the photosensitive drum 121 of the image forming section 12M. Due to this, a color toner image in which black toner, yellow toner, cyan toner, and magenta toner are layered is formed on the surface of the intermediate transfer belt 125*c*.

The paper transport path 111 is formed extending in a vertical direction at a rightward position of the image forming section 12 in FIG. 1. The transport roller pairs 112 are provided in appropriate locations on the paper transport path 111, and the recording papers P that are drawn out from the paper storage section 14 are transported by the drive of the transport roller pairs 112 toward the intermediate transfer belt 125*c* being rotated by the drive roller 125*a*.

The second transfer roller 113 is provided on the paper transport path 111 in contact with the surface of the intermediate transfer belt 125*c* at a position facing the drive roller 125*a*, and the toner image on the intermediate transfer belt 125*c* is transferred to the recording paper P due to the recording paper P being pressed and sandwiched between the intermediate transfer belt 125*c* and the second transfer roller 113 while being transported on the paper transport path 111.

The fixing section 13 executes a fixing process on the toner image on the paper transferred by the image forming section 12, and is provided with a hot roller 30, internally installed in which is an electric heating member such as a halogen lamp, and a pressure roller 40 that is disposed facing the circumferential surface of the hot roller 30. The recording paper P, which has been supplied to the fixing section 13 and on which is transferred the toner image from the intermediate transfer belt 125*c*, undergoes the fixing process, in which heat is obtained from the hot roller 30, by passing through a nip area between the hot roller 30 and the pressure roller 40, which are rotating.

The recording paper P on which the fixing process has been completed is discharged to a paper discharge tray 161 of the paper discharge section 16 arranged on a top portion of the apparatus main unit 11 by way of a paper discharge transport path 114, which is provided extending from an upper portion of the fixing section 13.

The toner supply section 15 is configured provided with a black cartridge 151K, a yellow cartridge 151Y, a cyan cartridge 151C, and a magenta cartridge 151M (hereinafter collectively referred to as "cartridge(s) 151"), which correspond to the development device 123 of the image forming section 12. One of the color toners is contained in each of the cartridges 151, which are detachably configured with respect to the apparatus main unit 11. When the toner amount in the cartridge 151 becomes low, toner is again replenished into the apparatus main unit 11 by replacing the cartridge with a new cartridge 151.

Furthermore, RFID tags 152K, 152Y, 152C, and 152M (hereinafter collectively referred to as "RFID tag(s) 152") are attached to the cartridges 151. Each of the RFID tags 152 is configured provided with a memory, which stores classification information of the cartridge 151 such as a product number and destination information of the cartridge 151, and a communication circuit, which transmits the information stored in the memory as a signal. The signals transmitted from the communication circuits are received by corresponding RFID communication sections 211K, 211Y, 211C, and 211M (hereinafter collectively referred to as "RFID communication section(s) 211") on an RFID board 21 installed in the apparatus main unit 11.

Figure 2A:
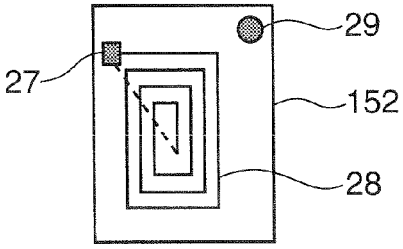
FIG. 2A is a diagram showing a board configuration of an RFID tag and FIG. 2B is a diagram showing a board configuration of an RFID board.
Figure 2B:
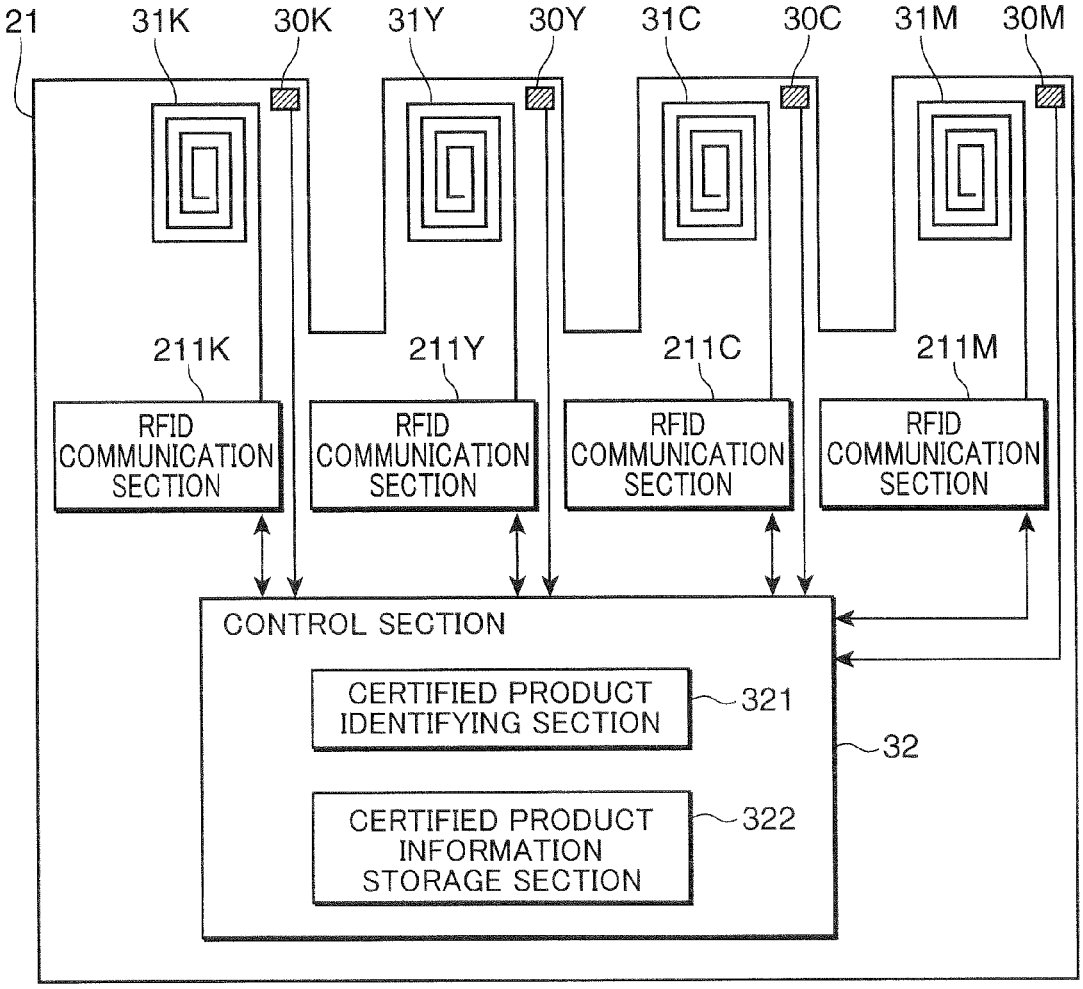

FIG. 2A is a diagram showing one example of a board configuration of the RFID tag 152 and FIG. 2B is a diagram showing one example of a board configuration of the RFID board 21. Arranged on the board of the RFID tag 152 are a communication circuit 27, which includes a memory that stores classification information, and an antenna 28 and a magnet 29. The antenna 28 transmits signals to the RFID communication section 211 and receives signals that are outputted from the RFID communication section 211. When the antenna 28 receives a signal instructing a readout of classification information, the communication circuit 27 reads out the classification information stored in the memory and transmits the classification information as a signal from the antenna 28.

The magnet 29 is a permanent magnet and is arranged such that the arrangement location of the magnet 29 is different for each destination of the cartridge 151. Detailed description is given later regarding the arrangement of the magnets corresponding to destination.

Arranged on the RFID communication section 21 are Hall element circuits 30K, 30Y, 30C, and 30M (hereinafter collectively referred to as "Hall element circuit(s) 30"), antennas 31K, 31Y, 31C, and 31M (hereinafter collectively referred to as "antenna(s) 31"), RFID communication sections 211, and a control section 32.

Figure 4:
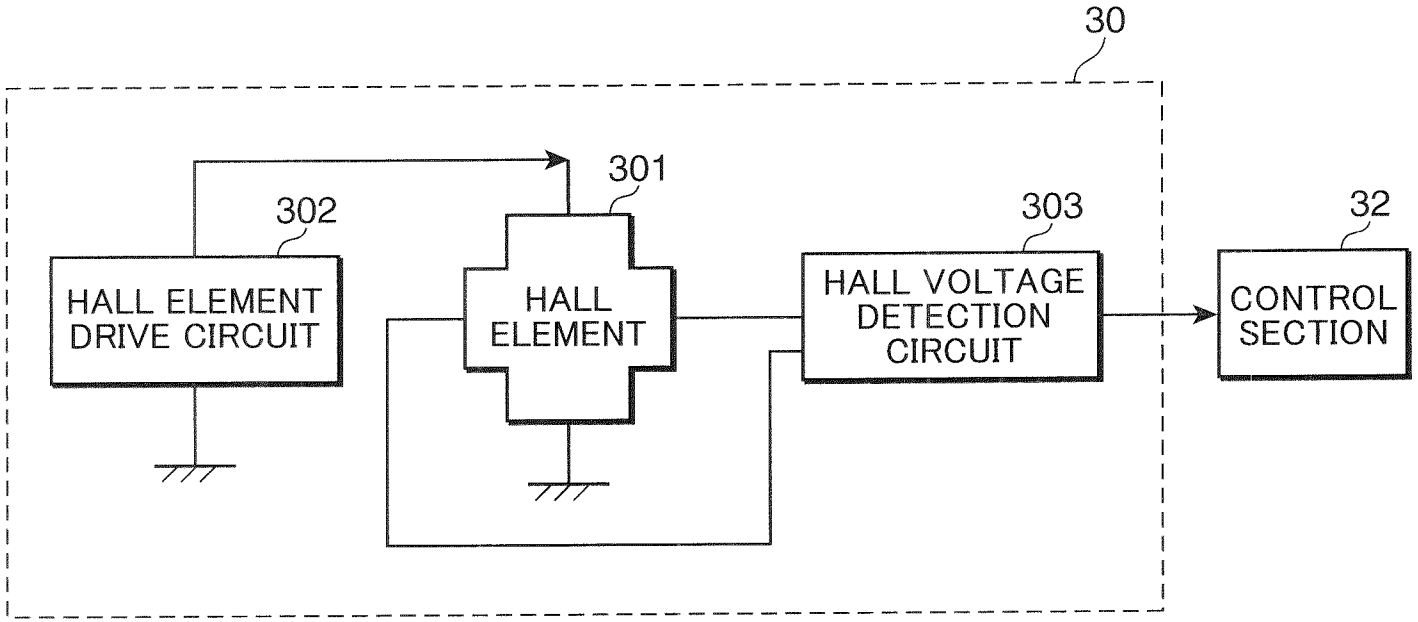
FIG. 4 is a diagram showing one example of a Hall element circuit.

The Hall element circuits 30 have a Hall element as a magnetoelectric transducer, and detect magnetic flux of the magnet 29 to output a detection signal to the control section 32. FIG. 4 is a diagram showing a configuration of the Hall element circuit 30. The Hall element circuit 30 is configured having a Hall element 301, a Hall element drive circuit 302, and a Hall voltage detection circuit 303. The Hall element 301 generates electromotive force in response to change in magnetic flux. The Hall element drive circuit 302 is a constant voltage or constant current circuit for driving the Hall element 301. The Hall voltage detection circuit 303 converts the electromotive force generated in the Hall element 301 to an electrical signal and outputs this to the control section 32.

The RFID communication section 211 carries out wireless communication with the RFID tag 152 in response to an instruction signal outputted from the control section 32, and is configured provided with components such as a carrier wave oscillator circuit, a modulation circuit, and a demodulation circuit. The antenna 31 is controlled by the RFID communication section 211 and carries out exchanges of signals between itself and the RFID tag 152.

The control section 32 is configured using a CPU (central processing unit) or the like, and is configured with components such as a certified product identifying section 321 and a certified product information storage section 322. The certified product information storage section 322 stores classification information (for example, information such as the product number and destination information on a certified cartridge), which is stored only on the RFID tag 152 attached to the certified cartridge. The certified product identifying section 321 compares the classification information that is read out from the RFID tag 152 and the information stored in the certified product information storage section 322, then further identifies whether or not the mounted cartridge 152 is a certified product depending on a presence/absence of a detection signal from the Hall element circuit 30.

FIGS. 2A and 2B are diagrams showing a case where the destination of the cartridge 151 is a country A, with FIG. 2A showing a board configuration of the RFID tag 152 and FIG. 2B showing a board configuration of the RFID board 21. In a case where the destination is the country A, for example, the magnet 29 is arranged at an upper right area of the board of the RFID tag 152. The Hall element circuit 30 is arranged on the RFID board 21 at a position intersecting the magnetic flux of the magnet 29.

Figure 3A:
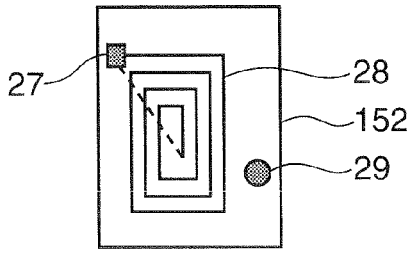
FIG. 3A is a diagram showing another example of a board configuration of an RFID tag and FIG. 3B is a diagram showing another example of a board configuration of an RFID board.
Figure 3B:
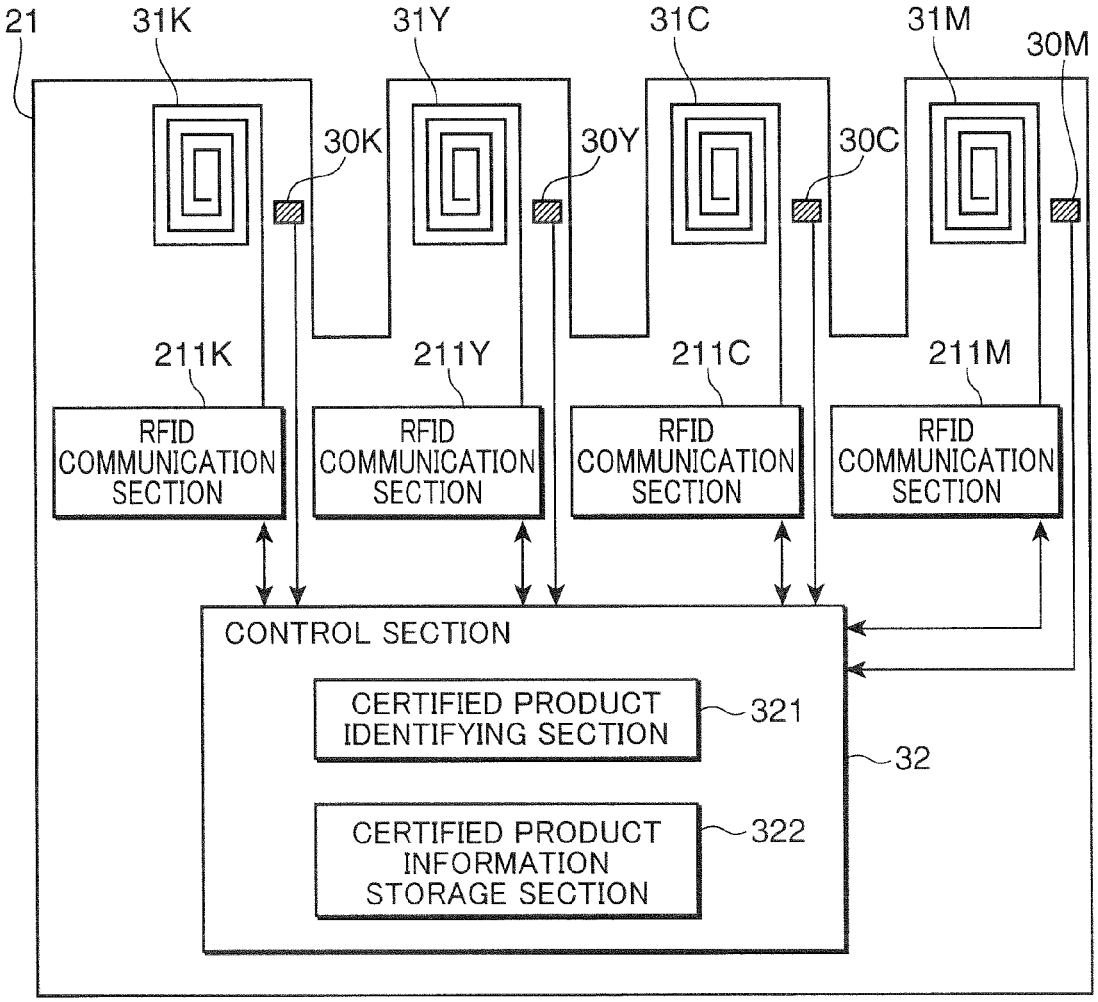

FIGS. 3A and 3B are diagrams showing a case where the destination of the cartridge 151 is a country B, with FIG. 3A showing a board configuration of the RFID tag 152 and FIG. 3B showing a board configuration of the RFID board 21. In a case where the destination is the country B, for example, the magnet 29 is arranged at a lower right area of the board of the RFID tag 152. The Hall element circuit 30 is arranged on the RFID board 21 at a position intersecting the magnetic flux of this magnet 29.

That is, when a certified cartridge is mounted in the printer 1 (the destination of the printer 1 and the cartridge are the same), the positions of the Hall element circuit 30 and the magnet 29 correspond, and therefore the Hall element circuit 30 detects the magnetic flux of the magnet 29 on the RFID tag 152 attached to the cartridge and outputs a detection signal to the control section 32. However, when a non-certified cartridge is mounted in the printer 1 (the destination of the printer 1 and the cartridge are different), the positions of the Hall element circuit 30 and the magnet 29 do not correspond and the Hall element circuit 30 cannot detect the magnetic flux of the magnet 29 and no detection signal is outputted. The certified product identifying section 321 carries out identification of cartridges that are mounted using whether or not a detection signal is outputted from the Hall element circuit 30.

Figure 5:
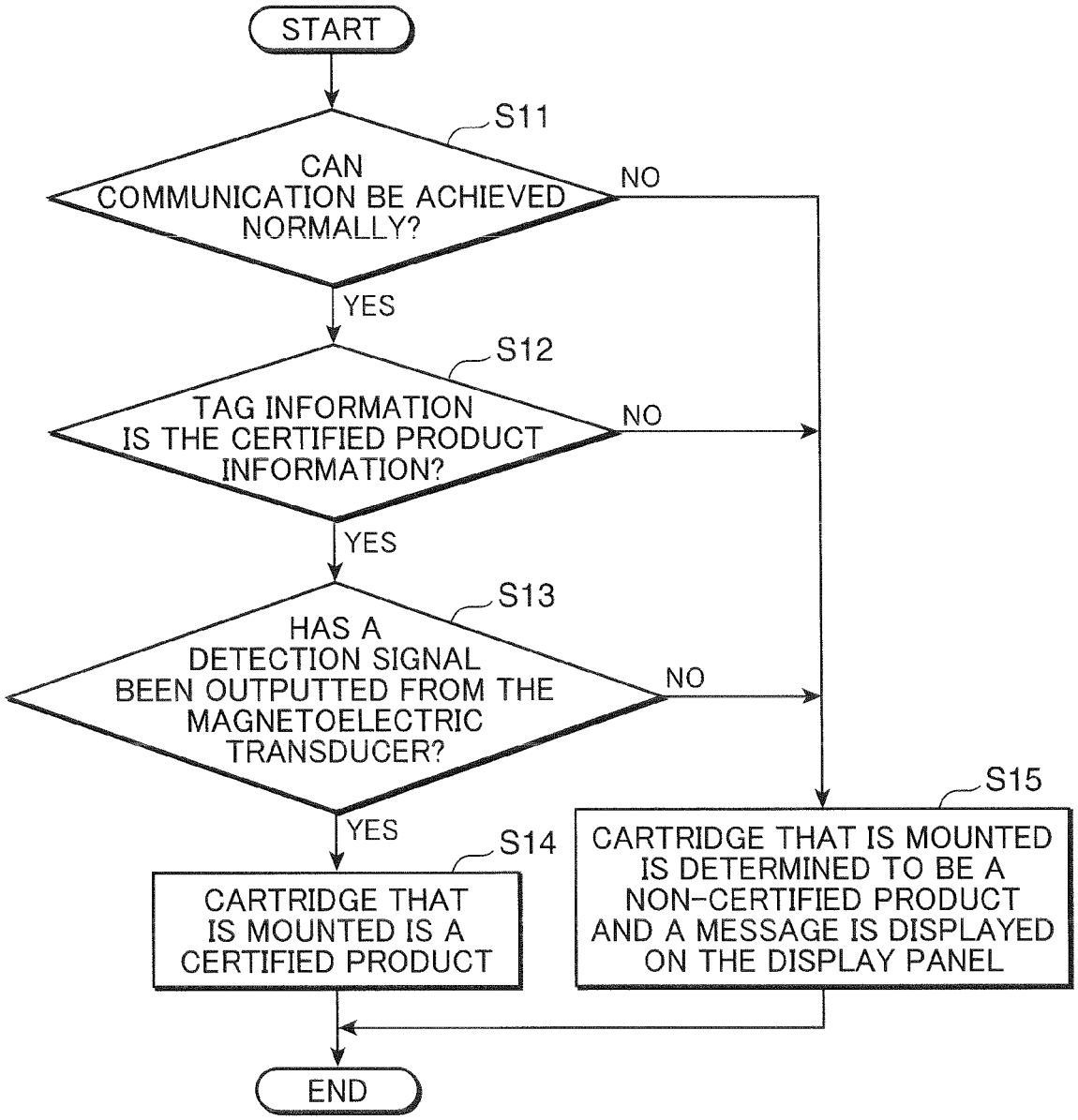
FIG. 5 is a flowchart showing a flow of processing of identifying whether or not a cartridge that is mounted is a certified product.

FIG. 5 is a flowchart showing a flow of processing of identifying whether or not a cartridge that is mounted is a certified product. After a cartridge is mounted in the printer 1, the control section 32 examines whether or not wireless communication can be achieved normally with the RFID tag 152 attached to the cartridge (step S11). Specifically, the control section 32 cause the RFID communication section 211 to transmits a signal instructing a readout of classification information stored in the RFID tag 152, and if a signal of some kind is returned from the RFID tag 152 in response to this signal, then the control section 32 determines that wireless communication can be achieved normally. However, in a case where wireless communication cannot be carried out normally (step S11; NO) for a reason such as an RFID tag 152 not being attached to the cartridge that is mounted (that is, the cartridge is a non-certified product) or it is a cartridge designed for a printer of another company and the attachment position of the RFID tag is different, then the certified product identifying section 321 determines that the mounted cartridge is a non-certified product and displays a warning message on the display panel or the like that indicates a non-certified cartridge is mounted (step S15).

In a case where wireless communication can be carried out normally between the RFID tag 152 and the RFID communication section 211 (step S11; YES), the certified product identifying section 321 reads out the classification information from the signals returned from the RFID tag 152 and compares this with the information stored in the certified product information storage section 322 (step S12). In a case where the classification information of the RFID tag 152 and the information stored in the certified product information storage section 322 are in agreement (step S12; YES), the certified product identifying section 321 determines whether or not a detection signal is being outputted from the Hall element circuit 30 (step S13). In a case where a detection signal is being outputted from the Hall element circuit 30 (step S13; YES), the certified product identifying section 321 determines that the cartridge that is mounted is a certified product (step S14).

On the other hand, in a case where the classification information of the RFID tag 152 and the information stored in the certified product information storage section 322 are not in agreement (step S12; NO) and a detection signal is not being outputted from the Hall element circuit 30 (step S13; NO), then the certified product identifying section 321 determines that the mounted cartridge is a non-certified product and displays a warning message on the display panel or the like that indicates a non-certified cartridge is mounted (step S15).

As described above, identification of certified products can be carried out simply and reliably by using a magnet 29 and a Hall element 301 in addition to a method using an RFID tag 152 as a method of identifying whether or not a cartridge that is mounted is a certified product. In a case where identification of certified products is carried out using only classification information stored in the RFID tag 152 as occurs conventionally, when a forged RFID tag is attached to a non-certified cartridge for example, it has not been possible to circumvent the non-certified product (fake product). However, by using the Hall element 301 in addition to the RFID tag 152, if no magnet 29 is attached to the cartridge, the cartridge can be identified as a non-certified product.

Further still, by varying the arrangement positions of the magnet 29 and the Hall element circuit 30 according to the type of cartridge (mainly its destination information), it is possible to prevent a cartridge for a different destination being mounted.

It should be noted that the present invention is not limited to the configuration of the present embodiment and that various modifications are possible. For example, in the present embodiment the magnet 29 is arranged on the board of the RFID tag 152, but in order to prevent forgery of cartridges based on reapplication of the RFID tag 152, it is also possible to embed the magnet 29 into the casing (into the resin) of the cartridge 151 or attach it to an inner wall of the casing. That is, in a form in which the magnet 29 is installed inside the casing of the cartridge 151, it is provided in positions such that the arrangement position of the magnet 29 is varied in response to the type (mainly the destination information) of the cartridge.

Further still, in the present embodiment, when wireless communication cannot be carried out normally between the RFID tag 152 and the RFID communication section 211 (step S11; NO), or the classification information of the RFID tag 152 and the information stored in the certified product information storage section 322 are not in agreement (step S12; NO), or a detection signal is not being outputted from the Hall element circuit 30 (step S13; NO), the control section 32 displays a warning message on the display panel, but it is also possible that, in addition to the warning message, control is carried out such that printing is forcibly prohibited.

In sum, an aspect of the present invention is an image forming apparatus provided with: an apparatus main unit that forms an image on a recording medium based on image data; and a cartridge that contains a developing agent and is detachably mountable with respect to the apparatus main unit, wherein the cartridge is provided with: a wireless tag that is stored classification information of the cartridge; and a magnet that is attached in a different position according to a type of the cartridge, and wherein the apparatus main unit is provided with: a communication section that read the classification information of the cartridge stored in the wireless tag by using wireless communication; a magnetoelectric transducer that is arranged in a position that intersects a magnetic flux of the magnet attached to the cartridge when a cartridge that is certified in advance is mounted to the apparatus main unit, and detects the magnetic flux of the magnet to output a detection signal; a storage section that stores classification information of the apparatus main unit; and an identifying section that identifies the mounted cartridge as a certified product when the classification information of the cartridge read by the communication section and the classification information of the apparatus main unit stored in the storage section are in agreement and the detection signal has been outputted from the magnetoelectric transducer.

In a case where identification of certified products is carried out using only tag information stored in a wireless tag as occurs conventionally, when a wireless tag, on which is recorded information indicating that it is a certified product, is attached to a non-certified cartridge for example, it has not been possible to circumvent the non-certified product (fake product). And although methods are conceivable of performing identification using a mechanical switch or the like, the effect of enabling circumvention of non-certified products is low compared to the cost of attaching a mechanical switch since this is easily imitated. However, with the present invention, in addition to a wireless tag, identification of non-certified products is carried out using a magnet and a magnetoelectric transducer, and therefore even if a forged wireless tag is attached to the non-certified product, identification of a cartridge as a non-certified product can be performed simply and reliably if a magnet is not attached.

Further still, by varying the arrangement positions of the magnet and the magnetoelectric transducer according to the type of cartridge (for example, its destination information), it is possible to prevent intentional or inadvertent mounting of a cartridge that is for a different destination.

Furthermore, an aspect of the present invention is the magnet attached to the cartridge is installed inside a casing of the cartridge.

Furthermore, an aspect of the present invention is a cartridge, which is detachably mountable with respect to an apparatus main unit that forms an image on a recording medium based on image data, and which contains a developing agent, the cartridge comprising: a wireless tag on which is stored classification information of the cartridge so that wireless communication with a communication section of the apparatus main unit is enabled when the cartridge is mounted to the apparatus main unit, and a magnet that is attached in the position at which magnetic flux detection is possible by a magnetoelectric transducer on the apparatus main unit side when the cartridge is mounted at the apparatus main unit.

Furthermore, an aspect of the present invention is the magnet that is attached in a different position according to a type of the cartridge, the position being a position at which magnetic flux detection is possible by a magnetoelectric transducer on the apparatus main unit side when the cartridge is mounted at the apparatus main unit.

Furthermore, another aspect of the present invention involves the magnet attached to the cartridge is installed inside a casing of the cartridge.

With this invention, the magnet is installed inside the casing (inside the resin) of the cartridge or is attached at an inner wall of the casing such that the magnet is not visible from outside, thereby making reapplication of the magnet difficult when the wireless tag is reapplied in order to forge a non-certified product, and this prevents forgery of cartridges.

Furthermore, an aspect of the present invention is an apparatus main unit of an image forming apparatus that forms an image on a recording medium based on image data, the apparatus main unit being provided with: a communication section read from a wireless tag provided on a cartridge classification information on the cartridge stored in the wireless tag by using wireless communication when a cartridge dedicated for mounting at the apparatus main unit is attached to the apparatus main unit, a magnetoelectric transducer that is arranged in a position that intersects a magnetic flux of the magnet attached to the cartridge when the cartridge is mounted to the apparatus main unit, and detects the magnetic flux of the magnet to output a detection signal, a storage section that stores classification information of the apparatus main unit, and an identifying section that identifies the mounted cartridge as a certified product when the classification information of the cartridge read by the communication section and the classification information of the apparatus main unit stored in the storage section are in agreement and the detection signal has been outputted from the magnetoelectric transducer.

This application is based on Japanese Patent Application Serial No. 2009-019106, filed in Japan Patent Office on Jan. 30, 2009, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus, comprising:

an apparatus main unit that forms an image on a recording medium based on image data; and a cartridge that contains a developing agent and is detachably mountable with respect to the apparatus main unit, wherein the cartridge is provided with:

a wireless tag that stores classification information of the cartridge; and a magnet that is arranged in a different position on a board of the wireless tag according to a type of the cartridge, and wherein the apparatus main unit is provided with:

a communication section that read the classification information of the cartridge stored in the wireless tag by using wireless communication;

a magnetoelectric transducer that is arranged in a position that intersects a magnetic flux of the magnet arranged on the board of the wireless tag with which the cartridge is provided when a cartridge that is certified in advance is mounted to the apparatus main unit, and detects the magnetic flux of the magnet to output a detection signal;

a storage section that stores classification information of the apparatus main unit; and an identifying section that identifies the mounted cartridge as a certified product when the classification information of the cartridge read by the communication section and the classification information of the apparatus main unit stored in the storage section are in agreement and the detection signal has been outputted from the magnetoelectric transducer.

2. The image forming apparatus according to claim 1, wherein the magnetoelectric transducer is a Hall element circuit.

3. The image forming apparatus according to claim 1, wherein said type of cartridge corresponds to a destination information of a country to which said cartridge and said apparatus main units are sent.

4. A cartridge, which is detachably mountable with respect to an apparatus main unit that forms an image on a recording medium based on image data, and that contains a developing agent, the cartridge comprising:

a wireless tag on which is stored classification information of the cartridge so that wireless communication with a communication section of the apparatus main unit is enabled when the cartridge is mounted to the apparatus main unit, and a magnet arranged in a position on a board of the wireless tag at which magnetic flux detection is possible by a magnetoelectric transducer on the apparatus main unit side when the cartridge is mounted at the apparatus main unit.

5. The cartridge according to claim 4, wherein the magnet that is attached in a different position according to a type of the cartridge, the position being a position at which magnetic flux detection is possible by a magnetoelectric transducer on the apparatus main unit side when the cartridge is mounted at the apparatus main unit.

* * * * *